US007077193B2

(12) United States Patent
Kamiyama et al.

(10) Patent No.: US 7,077,193 B2
(45) Date of Patent: Jul. 18, 2006

(54) COMPOUND TYPE HEAT EXCHANGER

(75) Inventors: Naohisa Kamiyama, Ashikaga (JP); Toshiharu Watanabe, Sano (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/842,118

(22) Filed: May 10, 2004

(65) Prior Publication Data

US 2004/0244953 A1 Dec. 9, 2004

(30) Foreign Application Priority Data

May 14, 2003 (JP) ..... 2003-135902

(51) Int. Cl.
*F28F 9/02* (2006.01)

(52) U.S. Cl. ..... 165/174; 165/140

(58) Field of Classification Search ..... 165/140, 165/177, 151–153, 174, 176
See application file for complete search history.

(56) References Cited

U.S. PATENT DOCUMENTS 5,690,166 A * 11/1997 Yamaguchi ..... 165/96
6,035,927 A * 3/2000 Krauss et al. ..... 165/135
6,394,176 B1 * 5/2002 Marsais ..... 165/140
2002/0023743 A1 * 2/2002 Jung et al. ..... 165/173

FOREIGN PATENT DOCUMENTS

| | | | |
|---|---|---|---|
| EP | 0 859 209 | * | 8/1998 |
| GB | 2 262 600 | * | 6/1993 |
| JP | 2000-018880 | | 1/2000 |

* cited by examiner

*Primary Examiner*—Teresa J. Walberg
(74) *Attorney, Agent, or Firm*—Kilpatrick Stockton LLP

(57) ABSTRACT

A compound type heat exchanger has an oil cooler unit and a condenser unit integrated with each other. Both of the units have a plurality of heat exchanging pipes and fins juxtaposed and alternately stacked into a lamination, in common. At both ends of the lamination in the longitudinal direction of the pipes, they are connected with header pipes. At a boundary between the units, the heat exchanger includes partition walls arranged in the header pipes and a pseudo heat exchanging passage member interposed in the lamination. Further, at least either one of two fins adjoining the pseudo heat exchanging passage member on the side of the oil cooler unit and also on the side of the condenser unit is joined to the pseudo heat exchanging passage member, while the other fins are joined to the pipes.

5 Claims, 14 Drawing Sheets

COMPOUND TYPE HEAT EXCHANGER

BACKGROUND OF THE INVENTION

The present invention relates to a compound type heat exchanger having a plurality of independent heat exchanging units, such as condenser and oil cooler, integrated with each other.

Normally, an automobile is equipped with some heat exchanging units, for example, a radiator for cooling an engine, an air conditioning condenser, an oil cooler for cooling automatic transmission oil (i.e. ATF oil cooler), an oil cooler for cooling engine oil and so on. Hitherto, the above radiator and the condenser are individually arranged in the front area of an engine. Recently, in view of reducing the installation space of such units for purpose of the downsizing of an engine and also reducing the number of assembling steps of the units, a compound type heat exchanger where a condenser and an oil cooler are integrated in one body has been developed.

In the compound type heat exchanger, however, there is a great difference in temperature between a heat exchanging medium flowing the condenser and oil flowing the oil cooler. Therefore, Japanese Patent Application Laid-open No. 2000-18880 discloses a compound type heat exchanger provided, between a condenser and an oil cooler, with a pseudo heat exchanging passage member in which such a heat exchanging medium does not flow.

In the above-mentioned compound type heat exchanger, however, fins are connected to both sides of the pseudo heat exchanging passage member by means of brazing. Therefore, there is a possibility that heat of oil flowing the oil cooler is transmitted to the heat exchanging medium flowing the condenser to deteriorate the heat exchanging efficiency of the heat exchanger.

SUMMARY OF THE INVENTION

In the above-mentioned situation, it is an object of the present invention to provide a compound type heat exchanger having a plurality of heat exchanging units, which can suppresses heat conduction from the heat exchanging unit of high temperature to the heat exchanging unit of low temperature.

In order to attain the above object, the present invention provides a compound type heat exchanger, comprising: a plurality of heat exchanging passage members each formed to allow passage of a heat exchanging medium therein, the heat exchanging passage members being juxtaposed to each other; a plurality of fins each interposed between the adjoining heat exchanging passage members so as to form a lamination having the heat exchanging passage members and the fins stacked alternately; a pair of header pipes arranged on both ends of the heat exchanging passage members and also connected to respective ends of the heat exchanging members; partition walls each arranged in the header pipes thereby to divide spaces inside the header pipes in a direction perpendicular to a longitudinal direction of the header pipes; and a pseudo heat exchanging passage member substituting for one heat exchanging passage member in the lamination at a position corresponding to the partition walls, the pseudo heat exchanging passage member being formed so as not to allow passage of the heat exchanging medium therein, wherein the lamination and the header pipes are divided in a direction perpendicular to a laminating direction at a boundary containing the partition walls and the pseudo heat exchanging passage member to form a first heat exchanging unit and a second heat exchanging unit, wherein at least either the fin adjoining the pseudo heat exchanging passage member on the side of the first heat exchanging unit or the fin also adjoining the pseudo heat exchanging passage member on the second heat exchanging unit is not joined to the pseudo heat exchanging passage member.

With the above-mentioned constitution, since at least either one of the fins adjoining the pseudo heat exchanging passage member is not joined to the pseudo heat exchanging passage member, it is possible to maintain high heat exchanging performance of the whole heat exchanger without producing heat currency between the first heat exchanging unit and the second heat exchanging unit.

In a preferred embodiment, both of the fin adjoining the pseudo heat exchanging passage member on the side of the first heat exchanging unit and the fin adjoining the pseudo heat exchanging passage member on the second heat exchanging unit may be not joined to the pseudo heat exchanging passage member.

With the above-mentioned constitution, since both of the fins adjoining the pseudo heat exchanging passage member are not joined to the pseudo heat exchanging passage member, it is possible to enhance the effect of the heat exchanger furthermore.

In another embodiment, the heat exchanging passage members are respectively coated with cladding layers of brazing materials while the pseudo heat exchanging passage member is coated with no cladding layer, and the heat exchanging passage members are respectively joined to the fins through the cladding layers, while the pseudo heat exchanging passage member is not joined to the fins due to the absence of the cladding layers.

In this embodiment, the fins are joined to the heat exchanging passage members through the cladding layers formed thereon. In other words, if the fin is not jointed to the heat exchanging passage members, it has only to form no cladding layer on the side surfaces of the pseudo heat exchanging passage member. Then, it is possible to manufacture the heat exchanger easily without altering the manufacture process of the heat exchanger remarkably.

In still another embodiment, the fins but the fins adjoining the pseudo heat exchanging passage member are respectively coated with cladding layers of brazing materials, and the heat exchanging passage members are respectively joined to the fins through the cladding layers, while the pseudo heat exchanging passage member is not joined to the fins due to the absence of the cladding layers.

In this embodiment, the fins are joined to the heat exchanging passage members through the cladding layers formed on the fins. In other words, if the fin is not joined to the heat exchanging passage members, it has only to form no cladding layer on the side surface of the fin. Then, it is possible to manufacture the heat exchanger easily.

In still anther embodiment, at least one of the fins adjoining the pseudo heat exchanging passage member is arranged apart from the pseudo heat exchanging passage member, whereby at least the one of the fins adjoining the pseudo heat exchanging passage member is not joined to the pseudo heat exchanging passage member.

In this embodiment, since at least one of the fins adjoining the pseudo heat exchanging passage member is arranged apart from the pseudo heat exchanging passage member, it is possible to interrupt the heat conduction between the first heat exchanging unit and the second heat exchanging unit effectively, whereby the heat exchanging performance of the heat exchanger as a whole can be maintained remarkably highly.

These and other objects and features of the present invention will become more fully apparent from the following description and appended claims taken in conjunction with the accompanying drawings.

DETAILED DESCRIPTION OF THE PREFERRED EMBODIMENT

Referring to accompanying drawings, embodiments of the present invention will be described below.

1st. Embodiment

Figure 1:
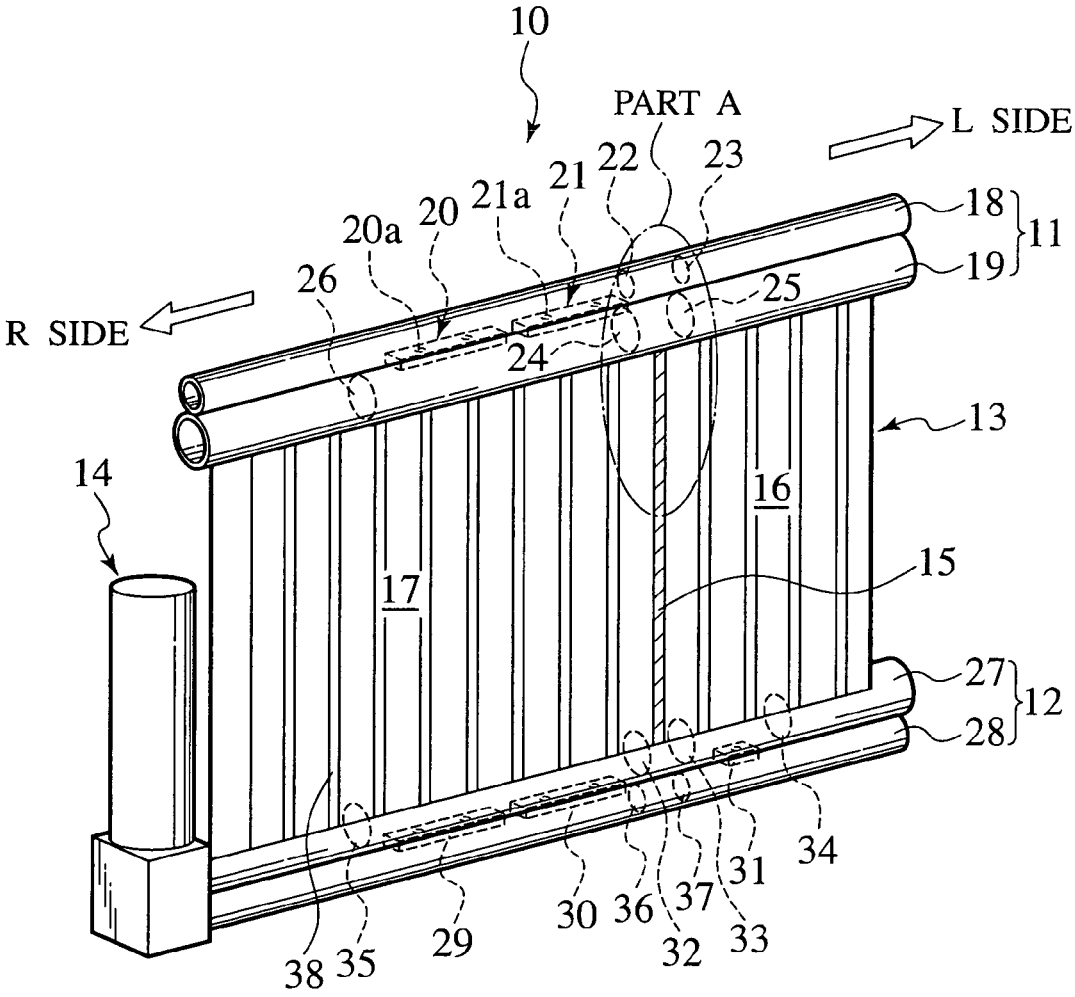
FIG. 1 is a perspective view of a heat exchanger in accordance with the first embodiment of the present invention.

FIG. 1 is a perspective view of a compound type heat exchanger 10 in accordance with the first embodiment of the present invention. As shown in this figure, the heat exchanger 10 of this embodiment includes an upper header pipe 11 on the upper side, a lower header pipe 12 on the lower side, a core part 13 connecting the upper header pipe 11 with the lower header pipe 12 in the vertical direction and a liquid tank 14 connected to the lateral side of the lower header pipe 12. This figure leaves out fins in order to clarify the constitution of the heat exchanger 10. A heat exchanger's part on the left side ("L" side shown in FIG. 1) of a pseudo heat exchanging passage member 15 constitutes an oil cooler unit 16 (as the first heat exchanging unit), while another heat exchanger's part on the right side ("R" side shown in FIG. 1) of the pseudo heat exchanging passage member 15 constitutes a condenser unit 17 (as the second heat exchanging unit). The condenser unit 17 serves to cool a cooling medium for air conditioning cycle, while the oil cooler unit 16 cools a transmission oil for an automatic car.

The upper header pipe 11 has an upper pipe 18 and a lower pipe 19 both of which are adjacent to each other in the vertical direction. The upper pipe 18 is communicated with the lower pipe 19 through joint members 20, 21 having a plurality of through-holes 20*a*, 21*a*, respectively. The upper pipe 18 is closed up by two disk-shaped partition walls 22, 23 positioned in the way of the pipe 18 in the longitudinal direction. Similarly, the lower pipe 19 is provided, therein, with partition walls 24, 25 at respective positions corresponding to the partition walls 22, 23 of the upper pipe 18. The lower pipe 19 further includes one partition wall 26 closer to the liquid tank 14. The above joint member 20, 21 are disposed between the partition wall 24 and the partition wall 26.

Similarly to the upper header pipe 11, the lower header pipe 12 is formed by an upper pipe 27 and a lower pipe 28 both of which are adjacent to each other. The upper pipe 27 is communicated with the lower pipe 28 through joint members 29, 30 and 31. Further, partition walls 32–37 are arranged in the pipes 27, 28, as shown in the figure. Juxtaposed in the core part 13 are a plurality of heat exchanging tubes 38 (as the heat exchanging passage members) that extend vertically and allow the heat exchanging medium to flow therein. Each of corrugated fins (see FIG. 2) is arranged between the adjoining heat exchanging tubes 38.

Figure 2:
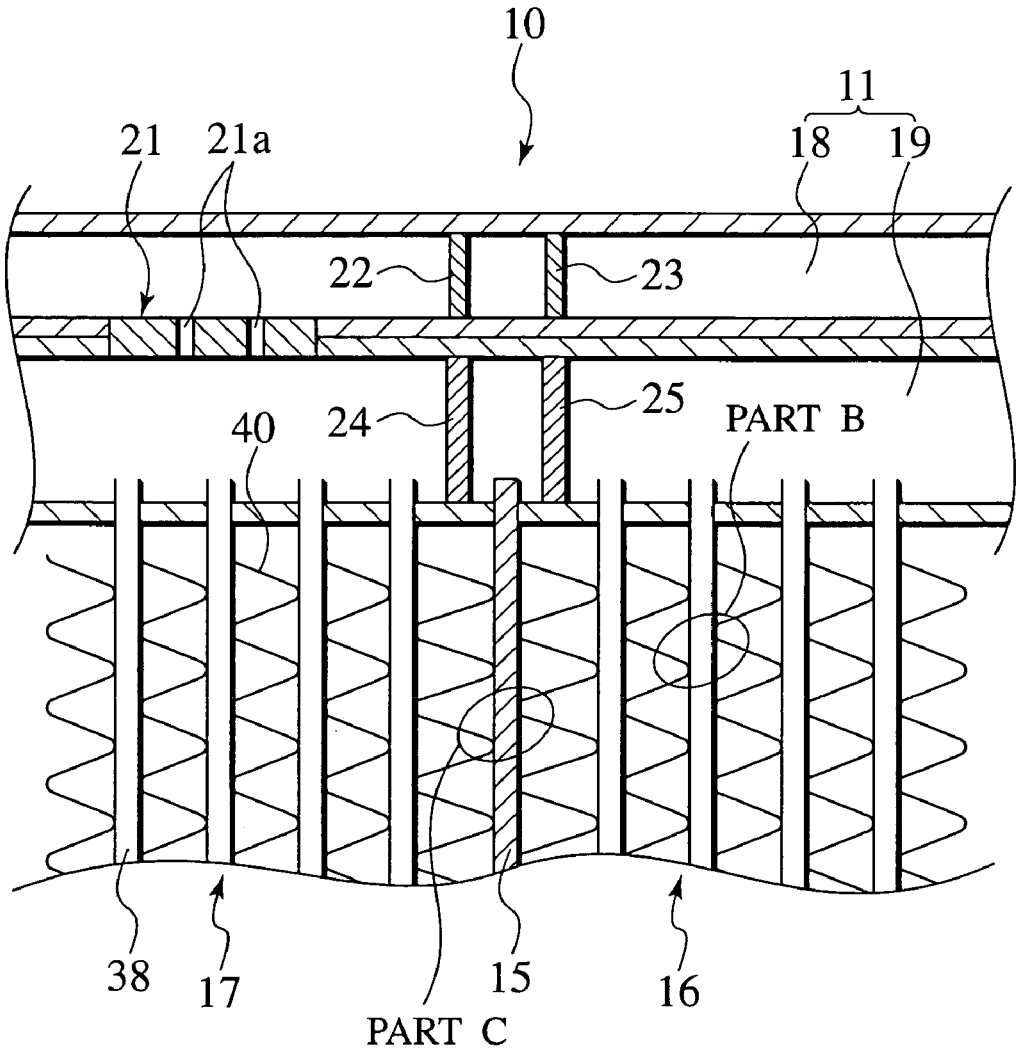
FIG. 2 is a sectional view of a part A of FIG. 1 in enlargement.

FIG. 2 is an enlarged sectional view of a part A of FIG. 1. As mentioned above, the upper and lower pipes 18, 19 are provided with the partition walls 22–25. Below a space between the opposing partition walls 22 and 23 and also another space between the opposing partition walls 24 and 25, the pseudo heat exchanging passage member 15 is arranged in the form of a solid member. Again, the pseudo heat exchanging passage member 15 is positioned at a boundary part between the condenser unit 17 and the oil cooler unit 16.

Figure 3:
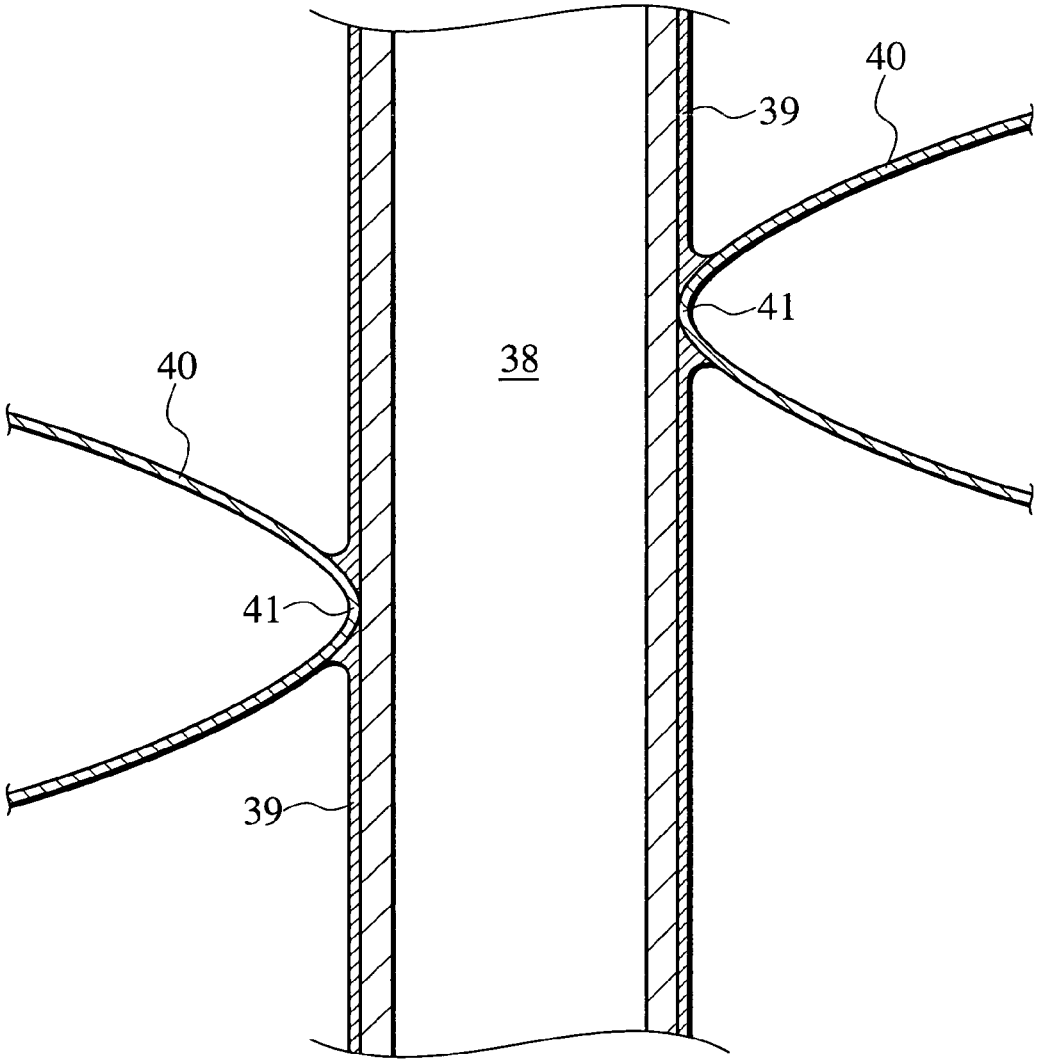
FIG. 3 is a sectional view of a part B of FIG. 2 in enlargement.

As shown in FIG. 3, each of the heat exchanging tubes 38 has an hollow interior and its outer surface coated with a cladding layer 39 made of a brazing material, through which the fins 40 are joined to the tube 38. In assembling, respective peaks 41 of the fins 40 abut on the cladding layer 39 of the brazing material (e.g. aluminum alloys) on the outer surface of the heat exchanging tube 39. In this state, by heating the whole heat exchanger, only the cladding layer 39 is molten, so that the fins 40 are welded to each of the tubes 38 by brazing.

Figure 4:
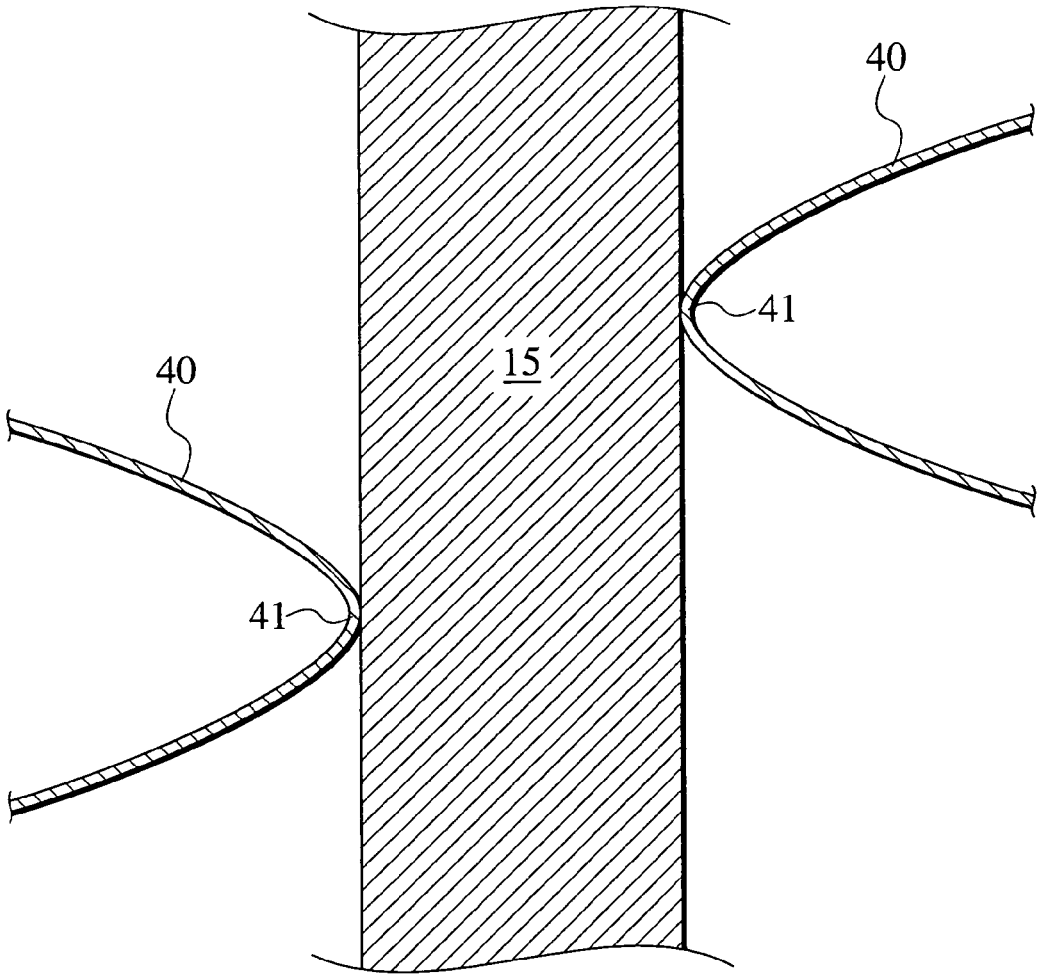
FIG. 4 is a sectional view of a part C of FIG. 2 in enlargement.

Meanwhile, as shown in FIG. 4 as a result of enlarging a part C of FIG. 2, it is noted that the fins 40 on both sides of the pseudo heat exchanging passage member 15 are not welded to the same member 15. That is, the cladding layers 39 of a brazing material is not formed on the outer surface of the pseudo heat exchanging passage member 15 at all, so that the peaks 41 of the fins 40 only come into line or point contact with the pseudo heat exchanging passage member 15.

Next, the manufacturing order of the heat exchanger 10 of the first embodiment will be described in brief.

First, it is performed to stack the tubes 38 and the fins 40 alternately while assembling both of the heat exchanging tubes 38 (see FIG. 3) coated with the cladding layers 39 and the corrugated fins 40 to the upper header pipe 11 and the lower header pipe 12, as shown in FIG. 2. Then, at a half-way position in such an assembling course, the pseudo heat exchanging passage member 15 with no cladding layer is arranged between two fins 40, in place of one heat exchanging tube 38. Thereafter, the fins 40 and the heat exchanging tubes 38 are again stacked one after the other. In this way, there is provided a heat exchanger 10 where one pseudo heat exchanging passage member 15 substituting for one heat exchanging tubes 38 in such a lamination at a position corresponding to the partition walls 22, 23, 24, 25, 32, 33, 36 and 37. Noted that, in the heat exchanger 10, the fins 40 are not welded to both sides of the pseudo heat exchanging passage member 15 at all.

Figure 5:
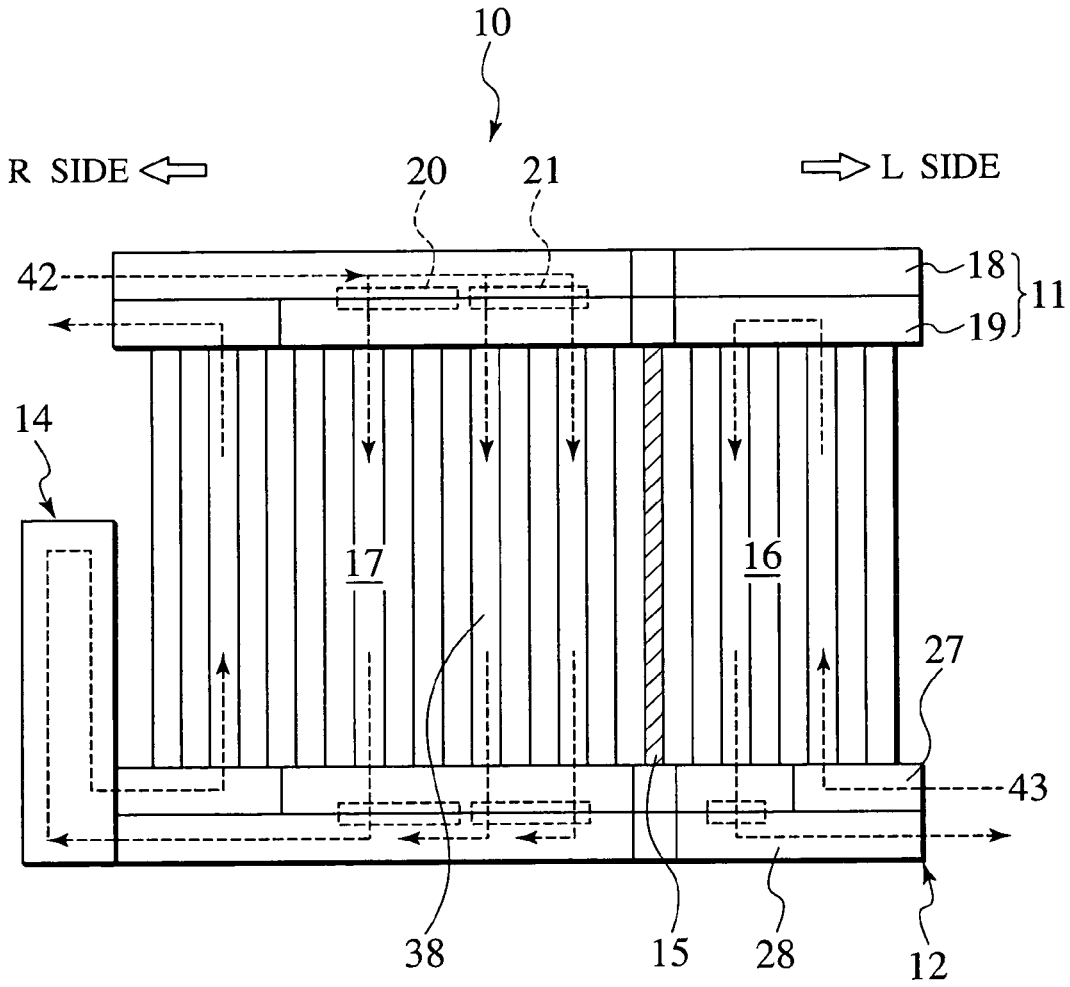
FIG. 5 is a perspective view showing the flows of both medium and oil in the heat exchanger of the first embodiment.

Referring to FIG. 5, the flows of a medium 42 and oil 43 in the heat exchanger 10 of the first embodiment will be described. Noted that the above-mentioned fins 40 are eliminated in FIG. 5 in order to clarify such flows of the medium 42 and the oil 43.

As shown in the figure, in the condenser unit 17 on the "R" side of the figure (i.e. the right side in the traveling direction), the medium 42 flowing into the upper pipe 18 of the upper header pipe 11 passes through the lower pipe 19 and successively flows in the heat exchanging pipes 38 downwardly. Subsequently, the medium 42 flows from the lower header pipe 12 to the liquid tank 14 and thereafter, the medium 42 flows in the heat exchanging pipes 38 upwardly. After that, the medium 42 is returned to an air-conditioning cycle through the lower pipe 19 of the upper header pipe 11.

On the other hand, in the oil cooler unit 16 on the "L" side of the figure (i.e. the left side in the traveling direction), the oil 43 entering from the upper pipe 27 of the lower header pipe 12 flows in the heat exchanging tubes 38 upwardly and turns back at the lower pipe 19 of the upper header pipe 11. Subsequently, after flowing in the heat exchanging pipes 38 downwardly, the oil is returned to a transmission through the lower pipe 28 of the lower header pipe 12. Noted that the temperature of the medium 42 flowing the condenser unit 17 is about 60° C., while the temperature of the oil flowing the oil cooler unit 16 is about 110° C. being a remarkable high temperature.

According to the heat exchanger 10 of the first embodiment, since the fins 40 are not joined to both sides of the pseudo heat exchanging passage member 15 at all, there is almost no heat conduction from the oil cooler unit 16 of high temperature to the condenser unit 17 of relatively how temperature, whereby the heat exchanging performance of the heat exchanger 10 as a whole can be maintained. Noted that, in the conventional heat exchanger, there is a possibility of heat conduction from an oil cooler unit of high temperature to a condenser unit through the intermediary of a pseudo heat exchanging passage member because fins are welded to the pseudo heat exchanging passage member through cladding layers of brazing material. While, in accordance with the heat exchanger 10 of this embodiment, as the fins 40 only come into line-contact or point-contact with the pseudo heat exchanging passage member 15, the quantity of heat conduction from the oil cooler unit 16 and the condenser unit 17 is remarkably reduced.

$2^{nd}$. Embodiment

Figure 6:
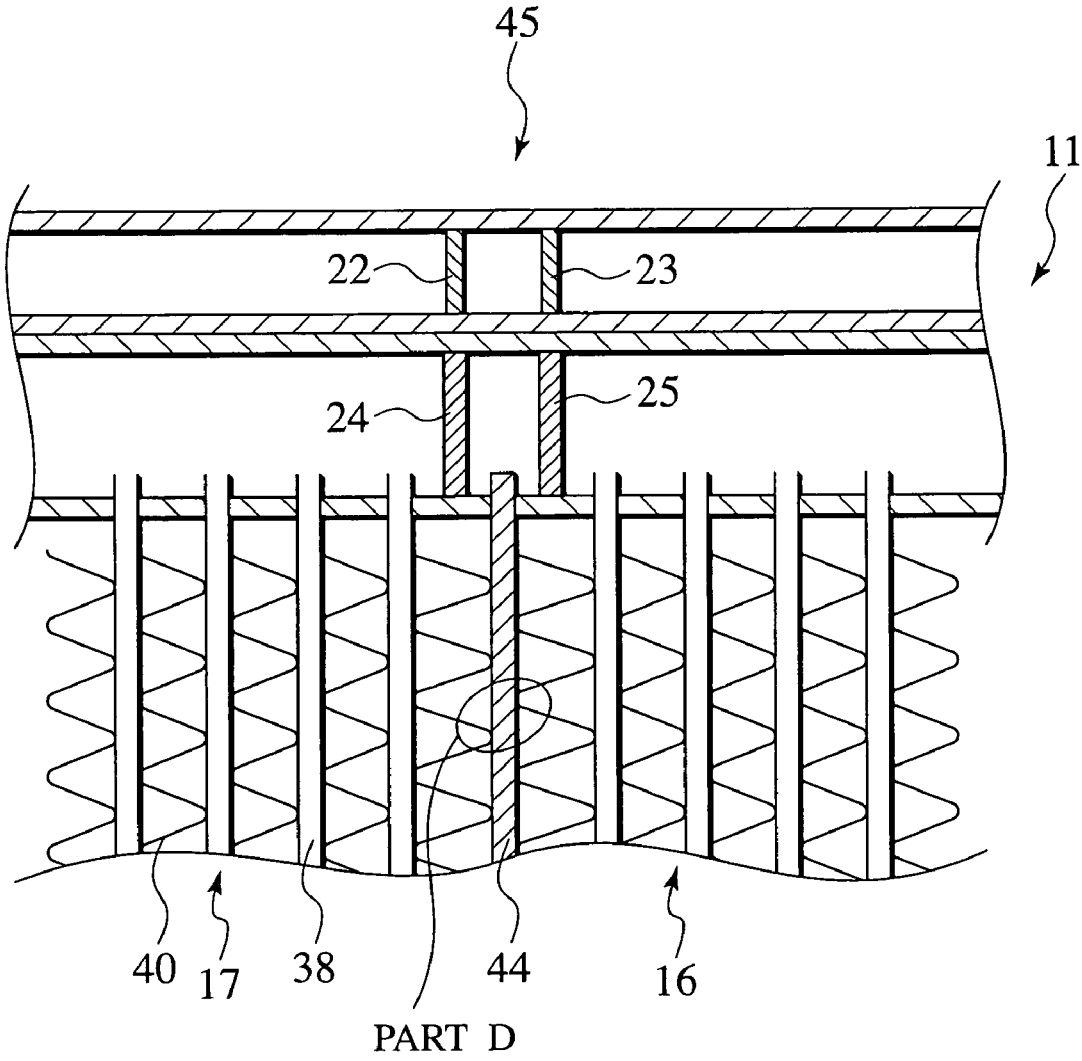
FIG. 6 is a sectional view of the substantial part of a heat exchanger in accordance with the second embodiment of the present invention.
Figure 7:
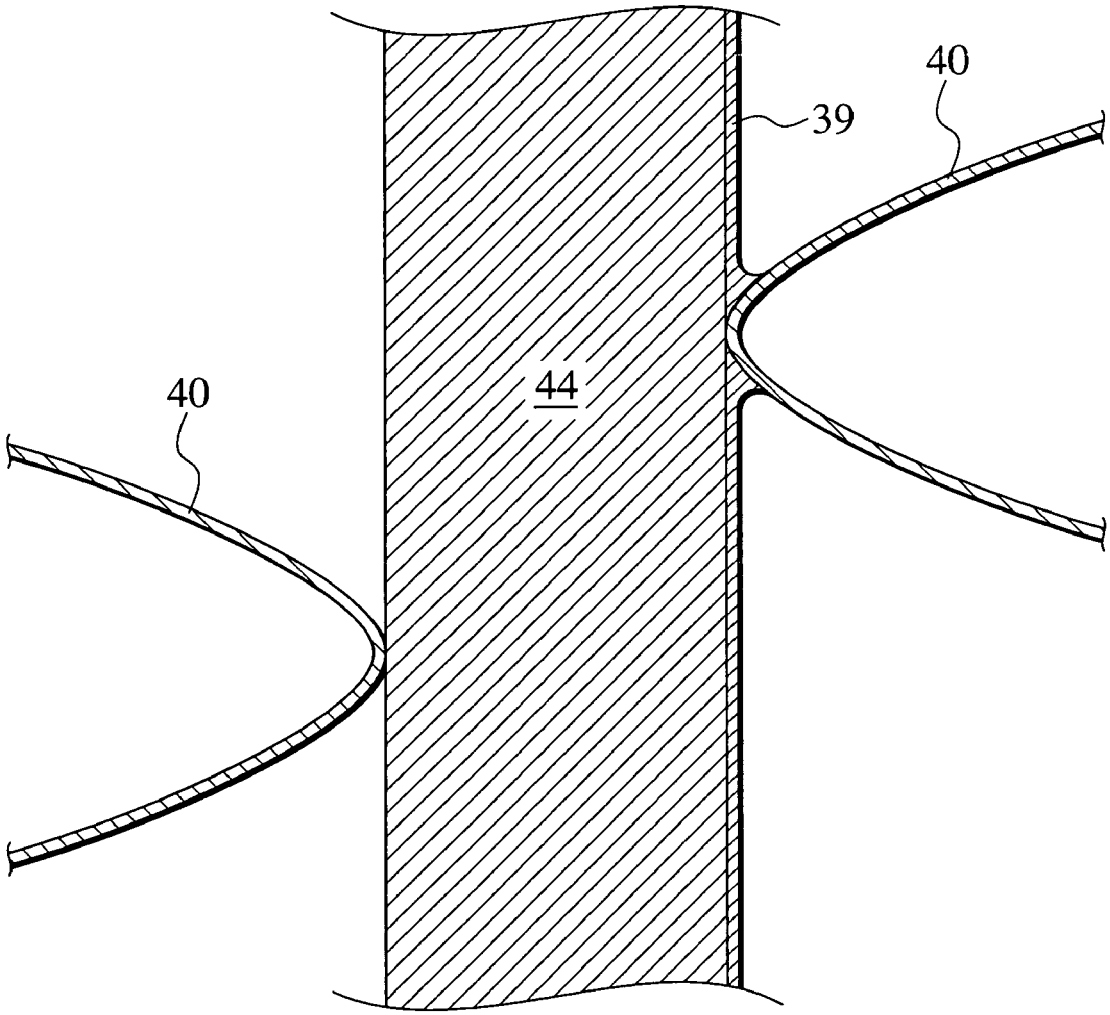
FIG. 7 is a sectional view of a part D of FIG. 6 in enlargement.

FIG. 6 shows a heat exchanger 45 in accordance with the second embodiment of the present invention. FIG. 7 is a partial view of the heat exchanger 45. Note, in this embodiment, elements identical to those of the first embodiment are respectively indicated with the same reference numerals and their overlapping descriptions are eliminated.

In the heat exchanger 45 of the second embodiment, the fins 40 are joined to the heat exchanging tubes 38 through cladding layers (not shown in FIG. 6), as similar to the first embodiment. The second embodiment differs from the first embodiment in the fins 40 adjoining a pseudo heat exchanging passage member 44.

As shown in FIG. 6, the heat exchanger 45 has a condenser unit 17 and an oil cooler unit 16 on both sides of the pseudo heat exchanging passage member 44, similarly to the first embodiment. The fins 40 are joined to the heat exchanging tubes 38.

However, as shown in FIG. 7, the pseudo heat exchanging passage member 44 is covered, only on its surface on the side of the oil cooler unit 16, with a cladding layer 39. While, the member's surface on the side of the condenser unit 17 is covered with no cladding layer. In other words, the fins 40 that adjoin the pseudo heat exchanging passage member 44 on the side of the oil cooler unit 16 are joined to the pseudo heat exchanging passage member 44, while the fins 40 that adjoin the pseudo heat exchanging passage member 44 on the side of the condenser unit 16 are not joined to the pseudo heat exchanging passage member 44 but only exhibiting either line-contact or point-contact.

According to the heat exchanger 45 of the second embodiment, since the fins 40 are not joined to the member's surface (on the side of the condenser unit 17) of the pseudo heat exchanging passage member 44, there is almost no heat conduction from the oil cooler unit 16 of high temperature to the condenser unit 17 of relatively how temperature, whereby the heat exchanging performance of the heat exchanger 10 as a whole can be maintained. Conversely, since the fins 40 are joined to the member's other surface (on the side of the oil cooler unit 16) of the pseudo heat exchanging passage member 44, it is possible to maintain high joint-strength about the fins 40 while suppressing heat conduction from the oil cooler unit 16 of high temperature to the condenser unit 17 of relatively how temperature.

$3^{rd}$. Embodiment

Figure 8:
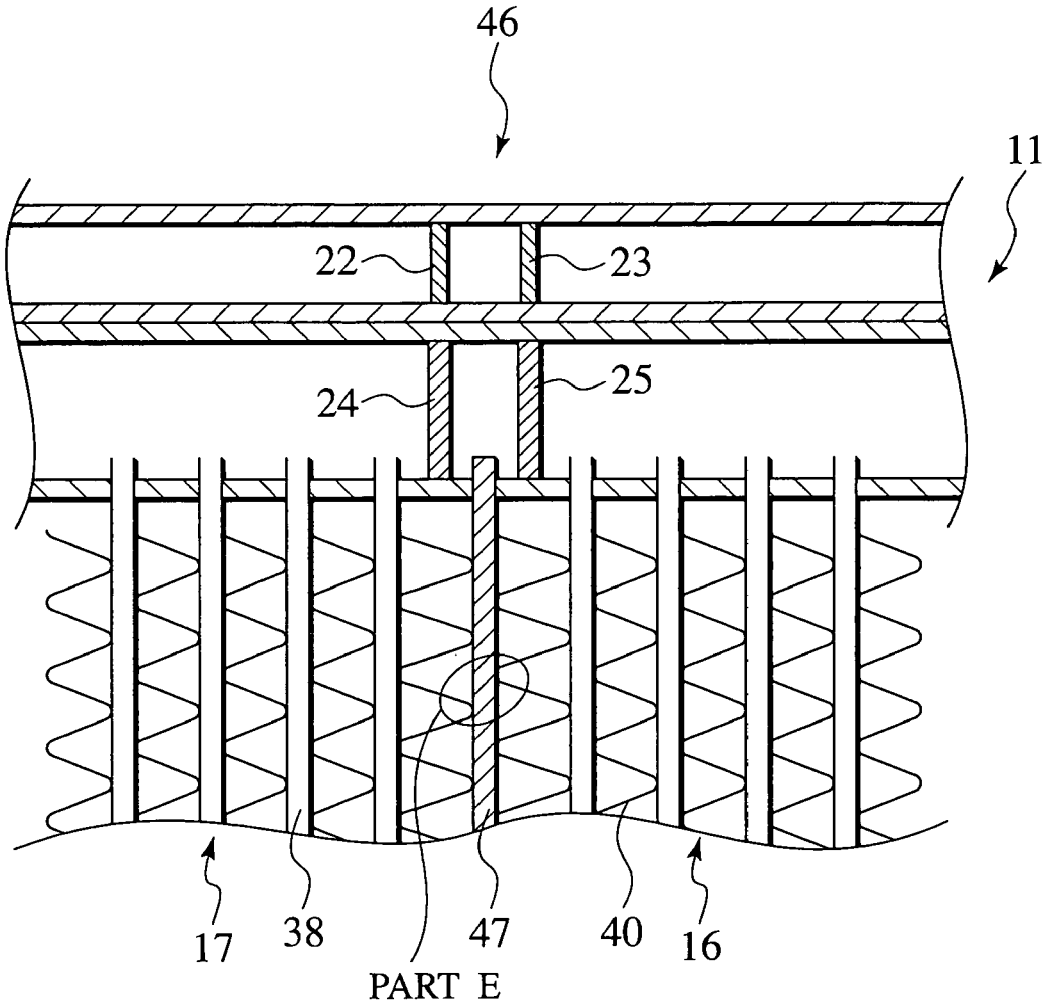
FIG. 8 is a sectional view of the substantial part of a heat exchanger in accordance with the third embodiment of the present invention.
Figure 9:
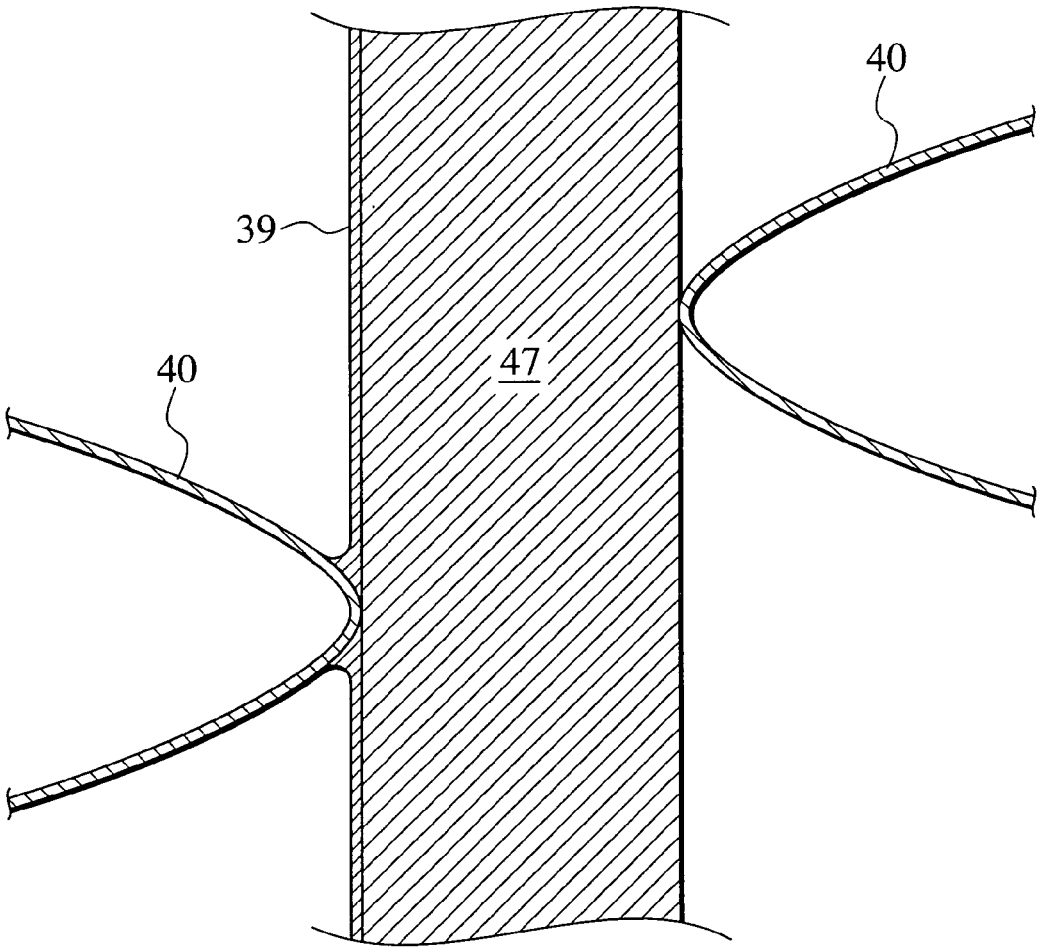
FIG. 9 is a sectional view of a part E of FIG. 8 in enlargement.

FIGS. 8 and 9 show the third embodiment of the present invention. In these figures, FIG. 8 shows a heat exchanger 46 of the third embodiment invention. FIG. 9 is a partial view of the heat exchanger 46. Note, also in this embodiment, elements identical to those of the first and second embodiments are respectively indicated with the same reference numerals and their overlapping descriptions are eliminated.

In the heat exchanger 46 of the second embodiment, the fins 40 are joined to the heat exchanging tubes 38 through cladding layers (not shown in FIG. 8), as similar to the first embodiment. The third embodiment differs from the first embodiment in the fins 40 adjoining a pseudo heat exchanging passage member 47.

As shown in FIG. 8, the heat exchanger 46 has a condenser unit 17 and an oil cooler unit 16 on both sides of the pseudo heat exchanging passage member 47, similarly to the first embodiment. The fins 40 are joined to the heat exchanging tubes 38.

However, as shown in FIG. 9, the pseudo heat exchanging passage member 47 is covered, only on its surface on the side of the condenser unit 16, with a cladding layer 39. While, the member's surface on the side of the oil cooler unit 16 is covered with no cladding layer. In other words, the fins 40 that adjoin the pseudo heat exchanging passage member 47 on the side of the condenser unit 17 are joined to the pseudo heat exchanging passage member 47, while the fins 40 that adjoin the pseudo heat exchanging passage member 47 on the side of the oil cooler unit 17 are not joined to the pseudo heat exchanging passage member 47 but only exhibiting either line-contact or point-contact.

According to the heat exchanger 46 of the third embodiment, since the fins 40 are not joined to the member's surface (on the side of the oil cooler unit 16) of the pseudo heat exchanging passage member 47, there is almost no heat conduction from the oil cooler unit 16 of high temperature to the condenser unit 17 of relatively how temperature, whereby the heat exchanging performance of the heat exchanger 46 as a whole can be maintained. Conversely, since the fins 40 are joined to the member's other surface (on the side of the condenser unit 17) of the pseudo heat exchanging passage member 47, it is possible to maintain high joint-strength about the fins 40 while suppressing heat conduction from the oil cooler unit 16 of high temperature to the condenser unit 17 of relatively how temperature.

$4^{th}$. Embodiment

Figure 10:
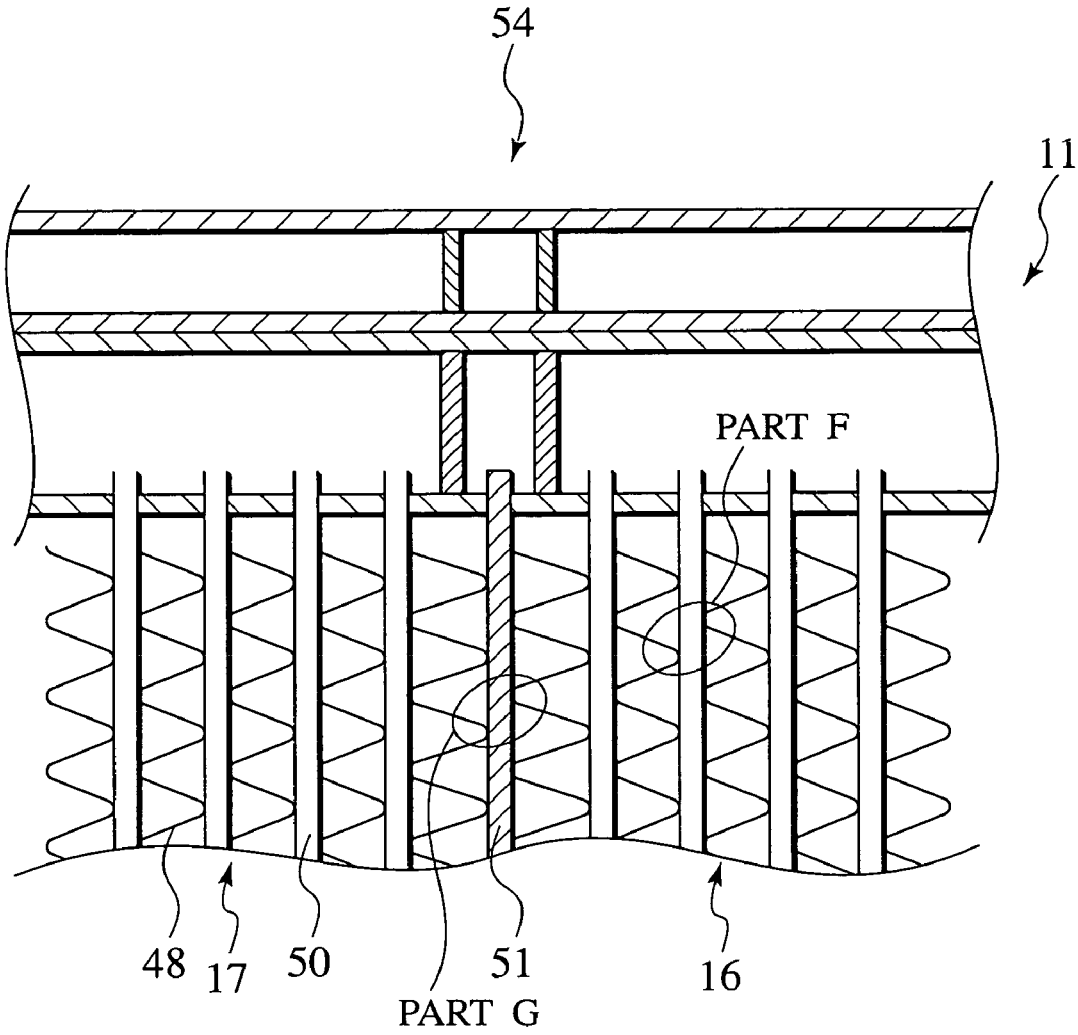
FIG. 10 is a sectional view of the substantial part of a heat exchanger in accordance with the fourth embodiment of the present invention.
Figure 11:
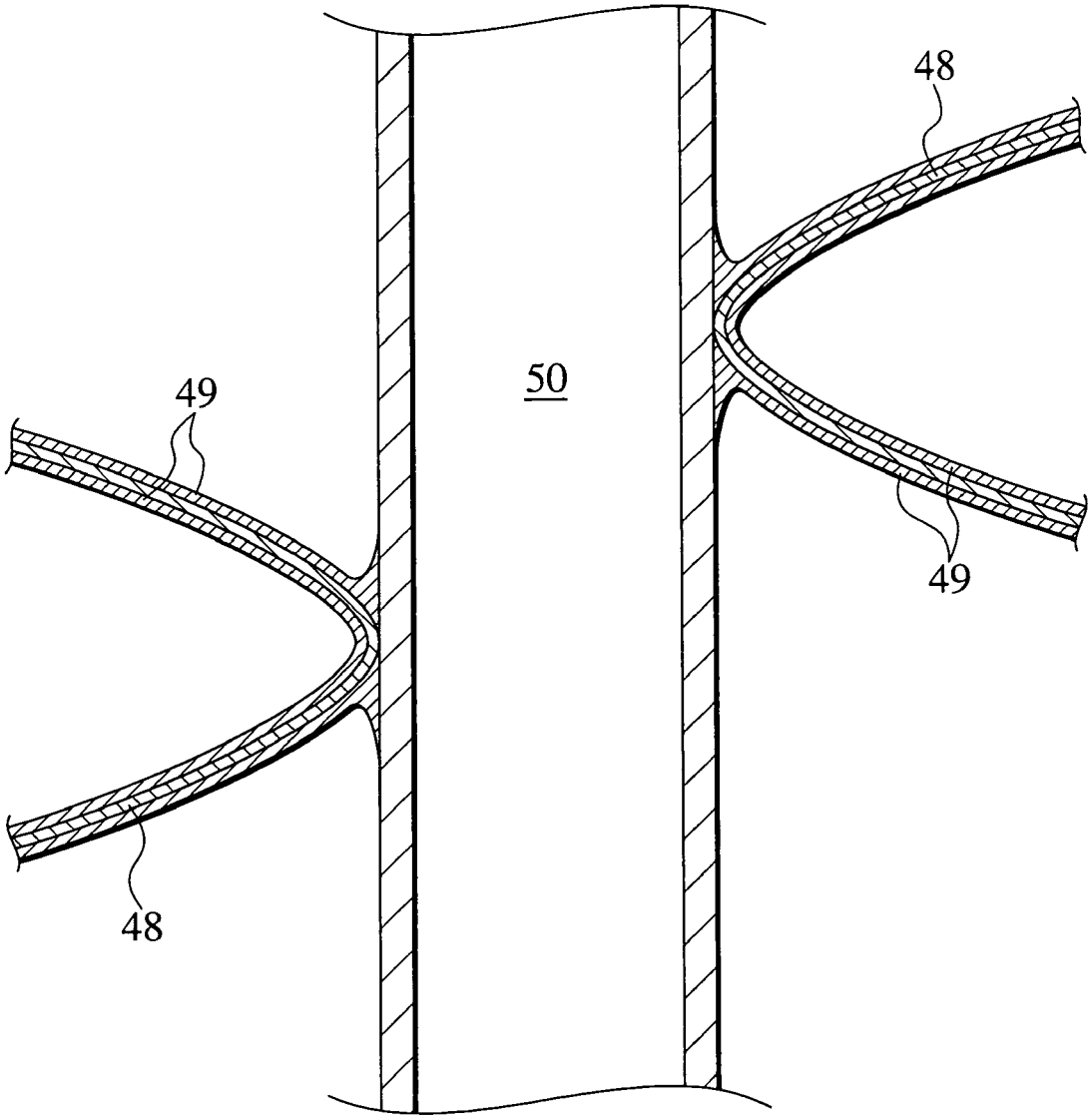
FIG. 11 is a sectional view of a part F of FIG. 10 in enlargement.
Figure 12:
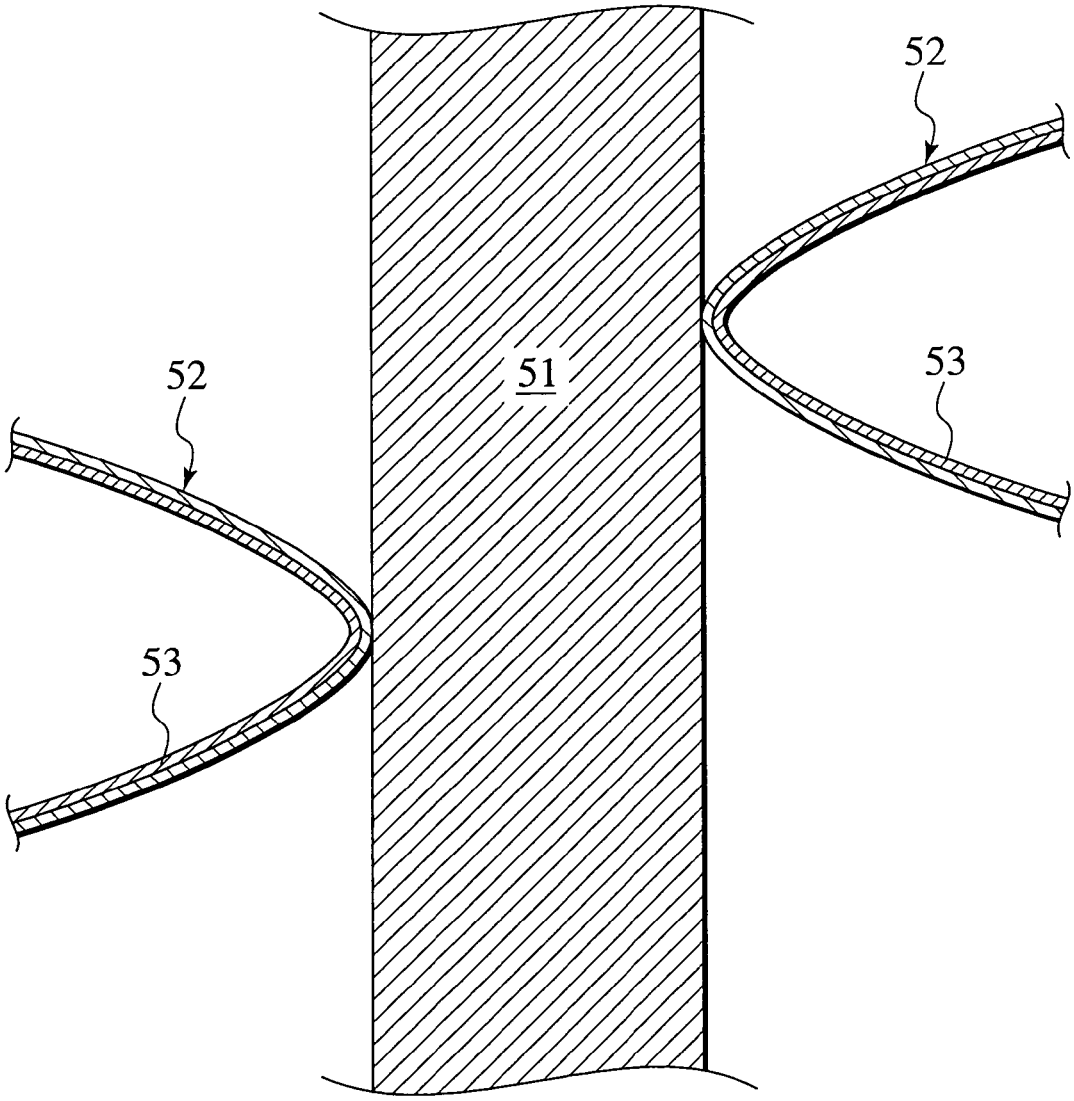
FIG. 12 is a sectional view of a part G of FIG. 10 in enlargement.

FIGS. 10 to 12 show the fourth embodiment of the present invention. In these figures, FIG. 10 shows a heat exchanger 54 of the fourth embodiment invention, FIG. 11 an enlarged view of a part F of the heat exchanger 54 and FIG. 12 an enlarged view of a part G of the heat exchanger 54. Note, also in this embodiment, elements identical to those of the previously-mentioned embodiments are respectively indicated with the same reference numerals and their overlapping descriptions are eliminated.

As shown in FIG. 10, the heat exchanger 54 has a condenser unit 17 and an oil cooler unit 16 on both sides of a pseudo heat exchanging passage member 51, similarly to the previously-mentioned embodiments. A number of fins 48 are joined to heat exchanging tubes 50.

In the heat exchanger 54 of the fourth embodiment, the fins 40 are covered with cladding layers 49 of brazing material and further joined to the heat exchanging tubes 50 through the cladding layers 49, as shown in FIG. 11. Noted, the so-formed fins 48 may be produced by coating cladding layers on both surfaces of one plate member and further corrugating the plate member. As shown in FIG. 12, regarding a plurality of fins 52 adjoining the pseudo heat exchanging passage member 51, a cladding layer 53 is formed on one surface of each fin 52 apart from the member 51. While, no cladding layer is formed on the other surface of each fin 52 facing the pseudo heat exchanging passage member 51, so that there exists either line-contact or point-contact between the fins 52 and the member 51 only.

According to the heat exchanger 54 of the fourth embodiment, since the fins 52 are not joined to both surfaces of the pseudo heat exchanging passage member 51, there is almost no heat conduction from the oil cooler unit 16 of high temperature to the condenser unit 17 of relatively how temperature, whereby the heat exchanging performance of the heat exchanger 54 as a whole can be maintained.

In the modification of the embodiment, the fins 52 may be joined to the only one surface of the pseudo heat exchanging passage member 51, which is on the side of the oil cooler unit 16 or the condenser unit 17, as occasion demands.

$5^{th}$. Embodiment

Figure 13:
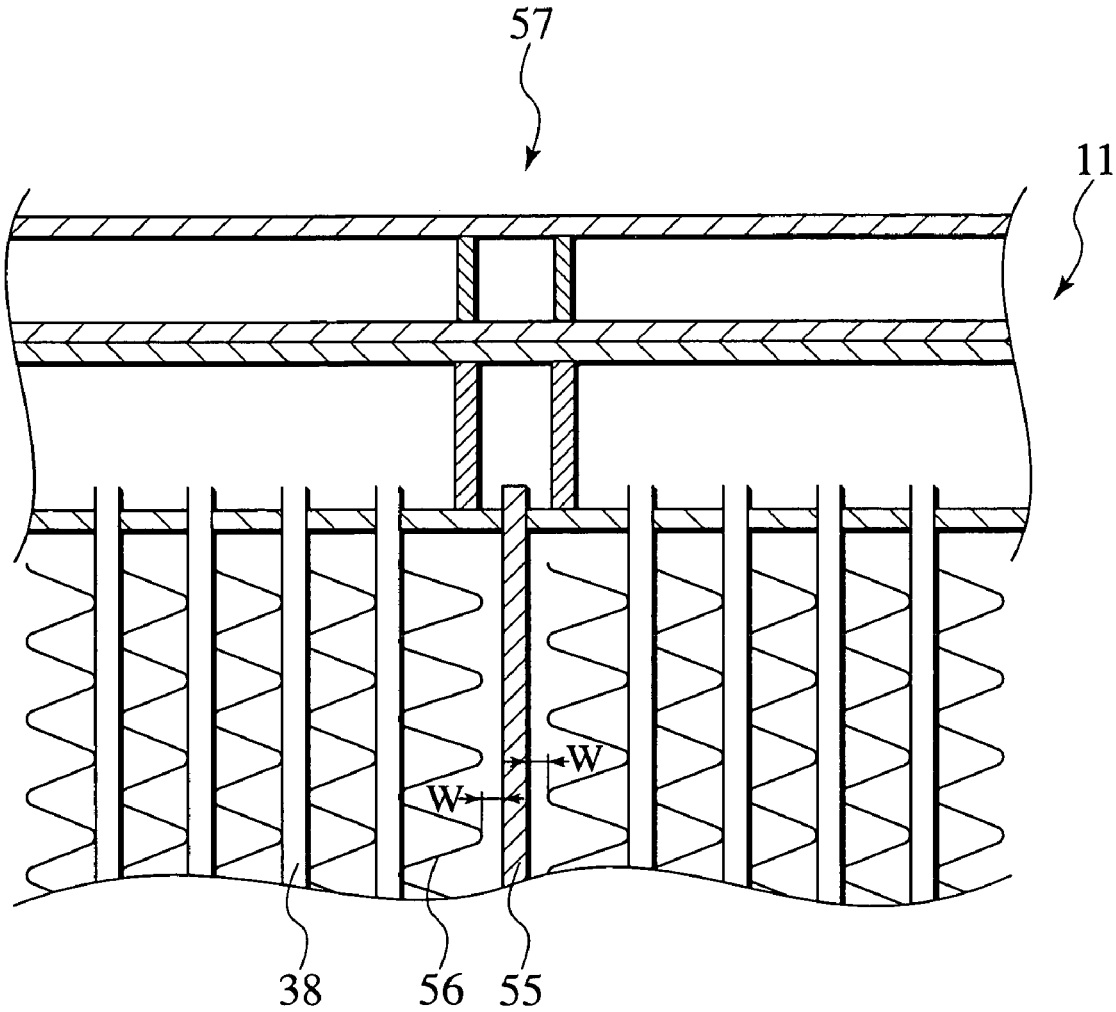
FIG. 13 is a sectional view of the substantial part of a heat exchanger in accordance with the fifth embodiment of the present invention.
Figure 14:
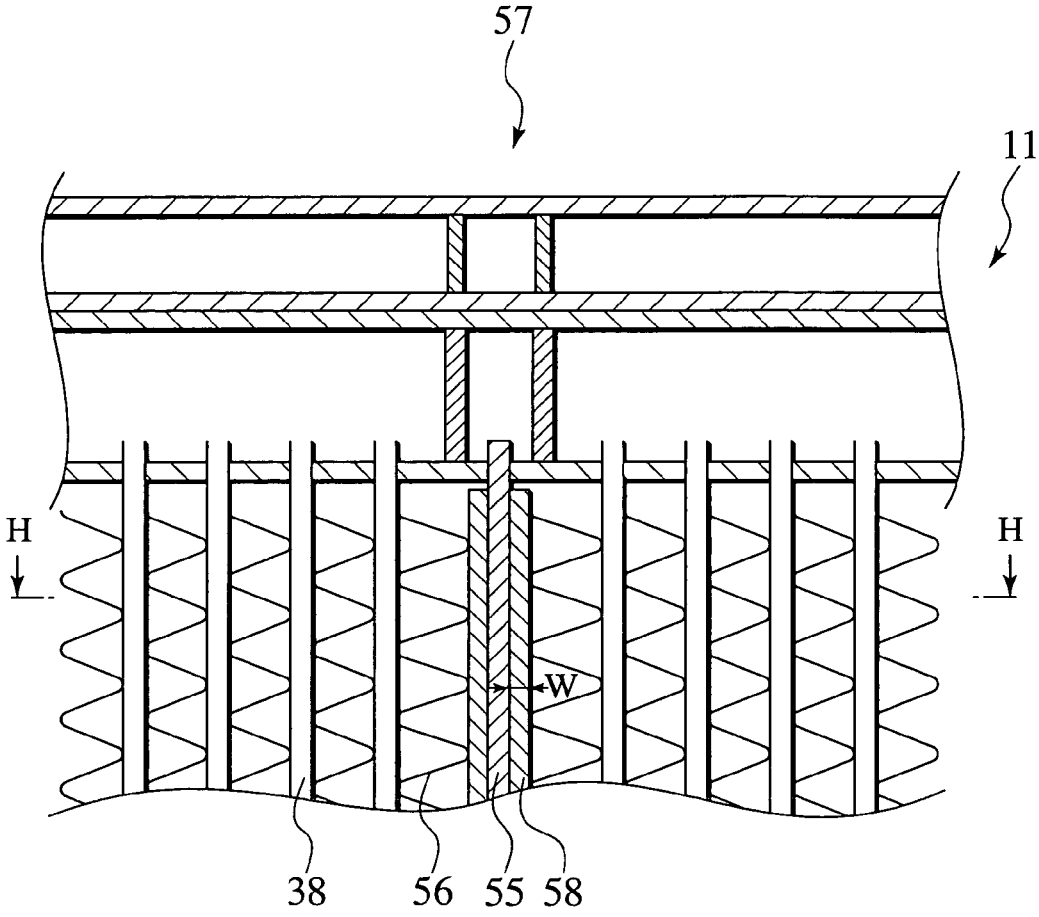
FIG. 14 is a sectional view showing a midway stage of the production of the heat exchanger of the fourth embodiment of the invention.
Figure 15:
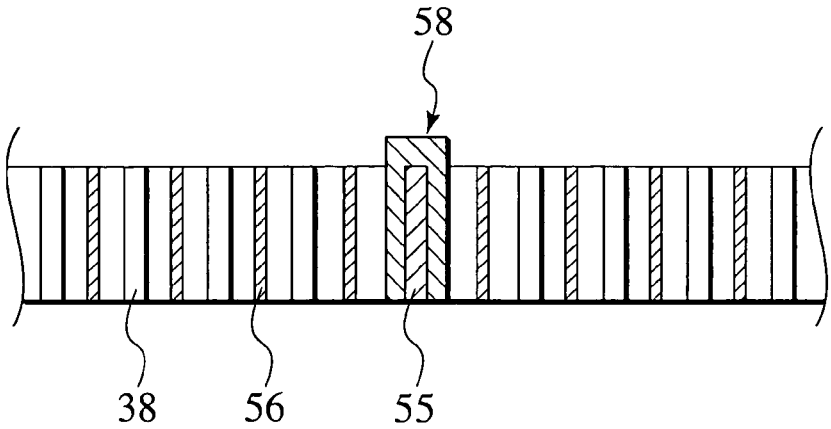
FIG. 15 is a sectional view taken along a line H—H of FIG. 14.

FIGS. 13 to 15 show the fifth embodiment of the present invention. Note, also in this embodiment, elements identical to those of the previously-mentioned embodiments are respectively indicated with the same reference numerals and their overlapping descriptions are eliminated.

According to this embodiment, as shown in FIG. 13, left and right fins 56, 56 on both sides of a pseudo heat exchanging passage member 55 are arranged apart from the member 55 at a gap W.

In the above fins 56, 56 neighboring the member 55, one fin 56 on the side of the oil cooler unit 16 is joined to only the heat exchanging tube 38 as a constituent of the unit 16 and is not joined to the member 55 through the gap W. Similarly, the other fin 56 on the side of the condenser unit 17 is joined to only the heat exchanging tube 38 as a constituent of the unit 17 and is not joined to the member 55 through the gap W.

The manufacturing order of a heat exchanger 57 of the fifth embodiment will be described in brief.

As shown in FIG. 14, it is first performed to laminate the heat exchanging tubes 38 and the fins 56 alternately. Then, at a half-way position in such a lamination, it is carried out to interpose the pseudo heat exchanging passage member 55 equipped with a brazing jig 58 (see FIG. 15) having a substantial U-shaped section in the lamination composed of the exchanging tubes 38 and the fins 56. Consequently, as shown in FIG. 14, there is produced a gap between the pseudo heat exchanging passage member 55 and the adjoining fin 56 on each side of member 55 due to the interposition of the brazing jig 58 having a thickness W. In this state, the whole heat exchanger is heated up and thereafter, the brazing jig 57 is removed from the heat exchanger. As a result, there can be produced the heat exchanger 57 that leaves the gaps W, W on both sides of the pseudo heat exchanging passage member 55. For the brazing jig 58, it is preferable to employ a jig that would not be subjected to joint with a cladding layer of a brazing material, for example, a jig excluding aluminum alloy etc.

According to the heat exchanger 57 of the fifth embodiment, since the fins 56, 56 on both sides of the pseudo heat exchanging passage member 55 are apart from the member 55 at the gaps W, W, there is almost no heat conduction from the oil cooler unit 16 of high temperature to the condenser unit 17 of relatively how temperature, whereby the heat exchanging performance of the heat exchanger 57 as a whole can be maintained.

In the modification of the embodiment, only the fin 56 on the side of the oil cooler unit 16 may be apart from the pseudo heat exchanging passage member 55. Alternatively, only the fin 56 on the side of the condenser unit 17 may be apart from the pseudo heat exchanging passage member 55.

Finally, it will be understood by those skilled in the art that the foregoing descriptions are nothing but some embodiments of the disclosed heat exchanger and therefore, various changes and modifications may be made within the scope of claims.

What is claimed is:

1. A compound type heat exchanger, comprising:

a plurality of heat exchanging passage members each formed to allow passage of a heat exchanging medium therein, the heat exchanging passage members being juxtaposed to each other;

a plurality of fins each interposed between the adjoining heat exchanging passage members so as to form a lamination having the heat exchanging passage members and the fins stacked alternately;

a pair of header pipes arranged on both ends of the heat exchanging passage members and also connected to respective ends of the heat exchanging passage members;

partition walls each arranged in the header pipes thereby to divide spaces inside the header pipes in a direction perpendicular to a longitudinal direction of the header pipes; and a pseudo heat exchanging passage member located at a position corresponding to the partition walls, wherein two of the fins adjoin the pseudo heat exchanging passage member wherein the lamination and the header pipes are divided in a direction perpendicular to a laminating direction at a boundary containing the partition walls and the pseudo heat exchanging passage member to form a first heat exchanging unit and a second heat exchanging unit, wherein there is a space between one of the fins adjoining the pseudo heat exchanging passage member and the pseudo heat exchanging passage member.

2. The compound type heat exchanger of claim 1, wherein the other fin adjoining the pseudo heat exchanging passage member is unbrazed to the pseudo heat exchanging passage member.

3. The compound type heat exchanger of claim 1, wherein the heat exchanging passage members are respectively coated with cladding layers of brazing materials while the pseudo heat exchanging passage member is uncoated, and the heat exchanging passage members are respectively joined to the fins through the cladding layers.

4. The compound type heat exchanger of claim 1, wherein the fins except for the fins adjoining the pseudo heat exchanging passage member are respectively coated with cladding layers of brazing materials, and the heat exchanging passage members are respectively joined to the fins through the cladding layers.

5. The compound type heat exchanger of claim 1, wherein there is a space between the other fin adjoining the pseudo heat exchanging passage member and the pseudo heat exchanging passage member.

* * * * *